US010320140B2

(12) United States Patent
Boutin

(10) Patent No.: US 10,320,140 B2
(45) Date of Patent: Jun. 11, 2019

(54) CRIMPING DIES FOR MAKING BENDS

(71) Applicant: Hubbell Incorporated, Shelton, CT (US)

(72) Inventor: Kris Robin Boutin, Mount Vernon, NH (US)

(73) Assignee: HUBBELL INCORPORATED, Shelton, CT (US)

( * ) Notice: Subject to any disclaimer, the term of this patent is extended or adjusted under 35 U.S.C. 154(b) by 33 days.

(21) Appl. No.: 15/062,294

(22) Filed: Mar. 7, 2016

(65) Prior Publication Data

US 2017/0256901 A1 Sep. 7, 2017

(51) Int. Cl.
*H01R 43/04* (2006.01)
*B21D 5/01* (2006.01)
*H01R 43/042* (2006.01)

(52) U.S. Cl.
CPC ..... *H01R 43/0428* (2013.01); *H01R 43/04* (2013.01); *B21D 5/01* (2013.01)

(58) Field of Classification Search
CPC .... B25B 9/04; B25B 7/02; B25B 7/04; B25B 7/126; B25B 5/163; H01R 43/042; H01R 43/0427; H01R 43/0428; H01R 43/484; H01R 43/48; B21D 5/01
See application file for complete search history.

(56) References Cited

U.S. PATENT DOCUMENTS 3,359,779 A * 12/1967 Filia ..... H01R 43/042 72/412
4,370,881 A * 2/1983 Peterpaul ..... B21D 22/06 29/753
5,730,022 A * 3/1998 Hansson ..... H01R 43/0427 72/409.14
2013/0240228 A1* 9/2013 Lefavour ..... H01R 43/042 173/20
2014/0260503 A1* 9/2014 Therrien ..... H01R 43/042 72/372

OTHER PUBLICATIONS

Merriam Webster Definition of Beyond.*

* cited by examiner

*Primary Examiner* — Pradeep C Battula
(74) *Attorney, Agent, or Firm* — Wissing Miller LLP

(57) ABSTRACT

A die set for bending work pieces using a power crimping tool, the die set including a first die including a first inside surface and a second inside surface angled a predetermined number of degrees relative to the first surface and a second die including an inside surface corresponding to the first inside surface of the first die and an inside surface corresponding to the second inside surface of the first die.

20 Claims, 7 Drawing Sheets

CRIMPING DIES FOR MAKING BENDS

BACKGROUND

Field

The present disclosure relates to crimping dies and, more particularly, to crimping dies for making bends.

Description of the Related Art

Many portable power tools are hand held tools that use electric motors to drive a working head used to perform various tasks, such as crimping, drilling, shaping, fastening, grinding, polishing, heating, etc. There is a segment of the portable tool product market that incorporate a hydraulic pump to enable the working head to apply a relatively large amount of force or pressure for a particular task. Such tools may operate with a hydraulic pump actuated by a battery powered electric motor. Battery powered hydraulic power tools are employed in numerous applications to provide an operator with a desired flexibility and mechanical advantage. For example, operators of crimping tools used for making crimping connections, such as crimping large power connectors onto large conductors, may need added force to crimp such large conductors, e.g., #8 conductors and larger, to suitable connectors. As another example, operators of cutting tools attempting to cut large conductors, e.g., #8 conductors and larger, benefit greatly when utilizing hydraulic power which enables the operator to apply greater force to quickly and cleanly cut such large conductors.

Heretofore, technicians working in the field have been required to carry with them wire lugs of various shapes and sizes. The wire lugs are generally aluminum or copper, although other metals and/or alloys may be utilized as suitable. The wire lugs generally include a wire receiving part and a connection part. The wire lugs are currently manufactured in straight form or in preformed angles where the wire receiving part of the wire lugs are at an angle relative to the connection part of the lug. Thus, in the field, service personnel need to carry with them numerous different angled types of lugs in the event they are needed for a particular job.

What is needed is a system that allows technicians in the field to carry just straight wire lugs. The wire lugs can then be bent by the technician at desired angles as suitable for a particular job.

SUMMARY

A die set for bending work pieces using a power crimping tool, the die set including a first die including a first inside surface and a second inside surface angled a predetermined number of degrees relative to the first surface and a second die including an inside surface corresponding to the first inside surface of the first die and an inside surface corresponding to the second inside surface of the first die.

A die set for bending work pieces using a power crimping tool, the die set including a pair of opposing dies having opposing surfaces between which forms a work area, wherein the opposing surfaces form a work area for bending a portion of the work piece at a predetermined angle with respect to another portion of the work piece.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Illustrative embodiments of the present disclosure may be provided as improvements to power crimpers. For example, a power crimper may be provided with dies capable of bending the wire receiving part of a wire lug at an angle relative to the connection part of the wire lug.

Illustrative embodiments of the present disclosure allow technicians in the field to carry straight wire lugs only. The technician in the field can then make appropriate bends in the wire lugs to suit a particular job requirement.

According to various illustrative embodiments of the present disclosure, die sets are provided for bending wire lugs to particular angles. With the die sets of the present disclosure, service personnel can carry one lug type—straight lugs—and make any required bends to the wire lugs as needed in the field.

In certain illustrative embodiments described herein, a die set may be constructed from a material that is generally harder and/or less malleable than the material being bent. For example, according to various embodiments of the present disclosure, die sets are provided for bending wire lugs which are generally made from relatively soft and/or malleable materials such as copper or aluminum. The die sets may be made from steel or an alloy that is relatively harder and/or less malleable than copper and/or aluminum.

Figure 1:
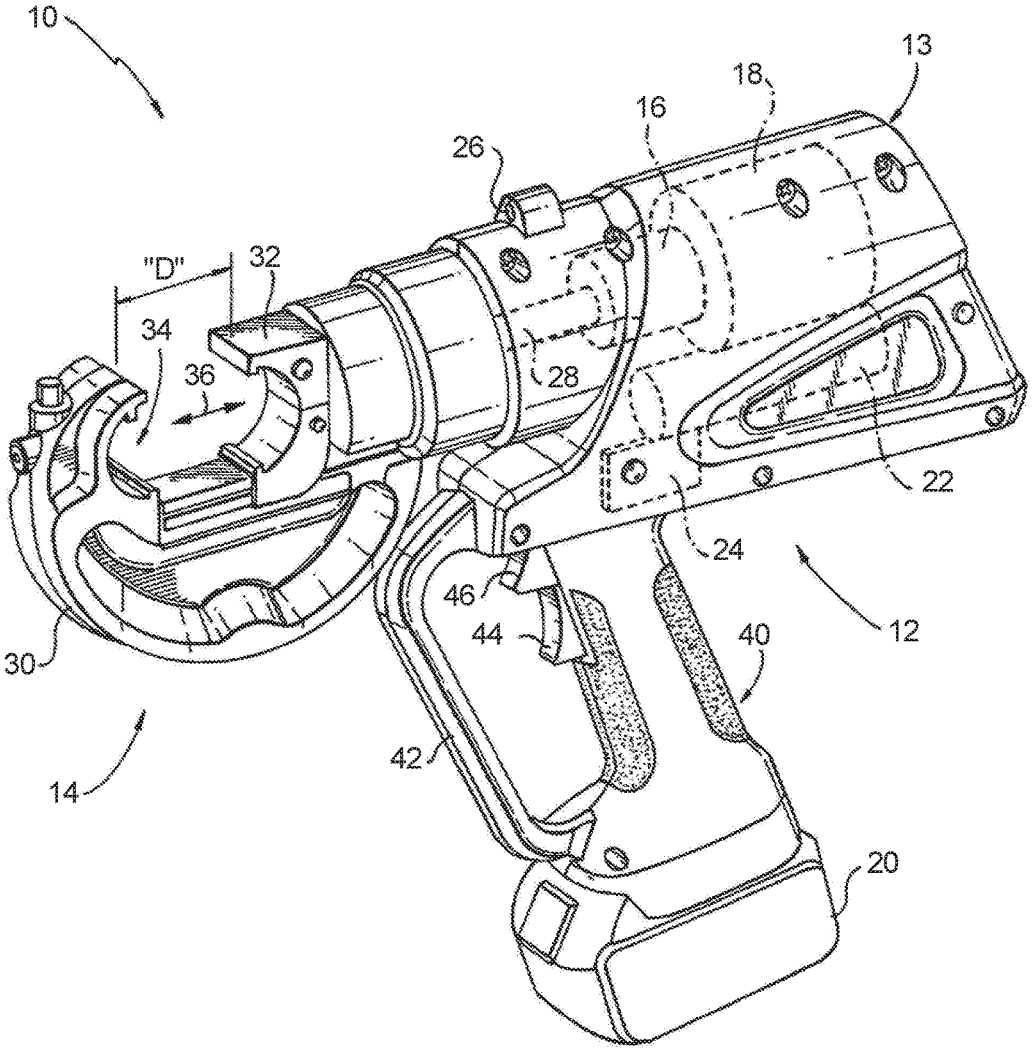
FIG. 1 is a perspective view of a power crimping/bending tool utilized according to illustrative embodiments of the present disclosure.

Referring to FIG. 1, there is shown a portable hand tool 10 according to an embodiment of the present disclosure. The portable hand tool shown in the figures and described herein is a portable, hand held, battery operated, hydraulic crimping tool. Although the present disclosure describes the hand tool as a portable, hand held, battery operated, hydraulic crimping tool, it should be understood that the tool of the present disclosure is not limited to such crimping tools. Features of the portable hand tool of the present disclosure could also be used in other types of tools, such as a battery operated, hydraulic bending tools or any other suitable type of battery operated tool. In addition, any suitable size, shape or type of elements or materials can be used to form the shape of the tool frame. For ease of description, the portable, hand held, battery operated, hydraulic crimping tool shown and described herein will be referred to as the "tool."

Figure 2:
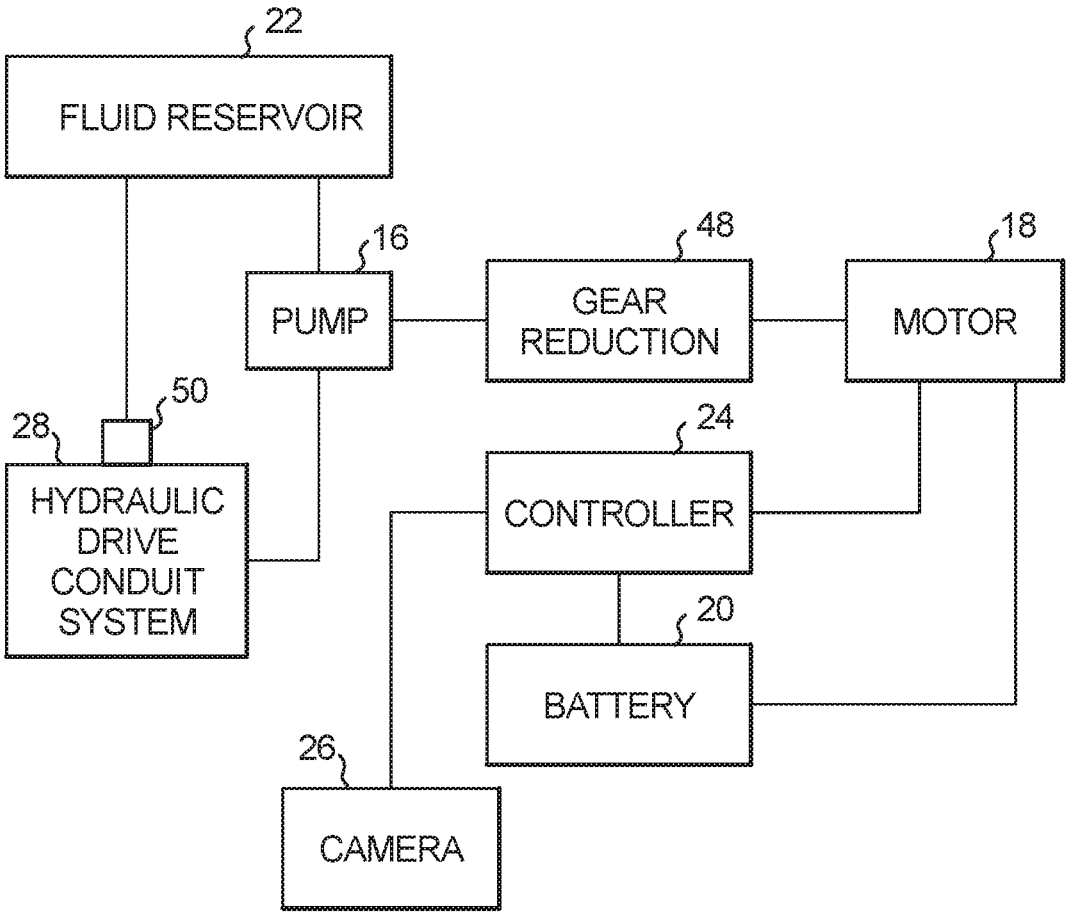
FIG. 2 is a block diagram for describing various parts of the power crimping/bending tool shown in FIG. 1 according to illustrative embodiments of the present disclosure.

Referring to FIGS. 1 and 2, the tool 10 according to an exemplary embodiment of the present disclosure generally includes a frame 12, a working head 14, a pump 16, a motor 18, a battery 20, a fluid reservoir 22, a controller 24 and a hydraulic drive conduit system 28. The frame 12 includes a main body 13 and a handle 40 that form a pistol-like shape. However, the frame 12 could be in any suitable type of shape, such as, for example, an in-line shape.

The pump 16, motor 18, fluid reservoir 22, controller 24, and hydraulic drive conduit system 28 are located within the main body 13 of the frame 12. The tool 10 may also include a camera 26 mounted to the frame 12 and oriented to provide a video of a working area of the working head 14. The working head 14 includes a frame section 30 and a ram 32. The frame section 30 may be connected to the front end of the frame 12 and fixed or locked in position, or the frame section 30 may be rotatably connected to the frame 12. The ram 32 is movably connected to the frame section 30 of the working head 14. In the exemplary embodiment shown, the frame section 30 and the ram 32 are adapted to removably receive conductor crimping dies (not shown) at a receiving area 34. According to embodiments of the present disclosure, the frame section 30 and ram 32 are also adapted to removably receive wire lug bending dies (not shown) at receiving area 34.

The ram 32 is adapted to move forward and backward as indicated by arrow 36. The hydraulic drive conduit system 28 is connected between the pump 16 and the rear end of the ram 32. Hydraulic fluid pumped by the pump 16 through the hydraulic drive conduit system 28 and against the rear end of the ram 32 causes the ram to move forward the distance "D" toward a distal end of the working head 14. The tool 10 preferably includes a spring (not shown) which is adapted, as is known in the art, to return the ram 32 to its rearward (or home) position when hydraulic fluid pressure is removed from the rear end of the ram 32. In the exemplary embodiment shown, the ram 32 has a rear end diameter of about 2 inches. However, the diameter of the rear end of the ram could have any suitable size or shape for functioning as a hydraulic fluid contact surface. In the exemplary embodiment shown, the ram 32 is adapted to move a distance "D" between its home position and its forward position which is towards the distal end of the working head 14. The distance "D" can be any distance suitable to perform the desired action of the working head 14, here the desired crimping and/or bending action. For example, the distance "D" could be between about 1 inch and about 2 inches, and preferably about 1.7 inches.

The handle 40 includes one or more operator controls, such as trigger switches 44 and 46, which can be activated by an operator by, for example, pressing the trigger switches. The handle 40 of the frame 12 may include a hand guard 42 to protect an operators hand while operating the tool 10 and to prevent unintended operation of trigger switches 44 and 46. According to an embodiment of the present disclosure, one of the trigger switches (e.g., trigger switch 44) is used to activate the ram 32 to move it toward the distal end of the working head 14 and perform the crimping or bending operation. The other trigger switch (e.g., trigger switch 46) is used to retract ram 32 to the base position shown in FIG. 1. The operator controls (e.g., trigger switches 44 and 46), are operably coupled to the controller 24. As shown in FIG. 1, a battery 20 is removably connected to the bottom of the handle 40. In another embodiment, the battery 20 could be removably mounted or connected to any suitable position on the frame 12. In another embodiment, the battery 20 may be affixed to the tool 10 so that it is not removable. The battery 20 is preferably a rechargeable battery, such as a lithium ion battery, that can output a voltage of at least 16 volts, and preferably in the range of between about 16 VDC and about 24 VDC. In the exemplary embodiment shown in FIG. 1, the battery 20 can output a voltage of about 18 VDC.

The motor 18 is coupled to the battery 20 and the controller 24, and its operation is controlled by the controller 24, which will be described in more detail below. Generally, the motor 18 is adapted to operate at a nominal voltage corresponding to the voltage of the battery 20, i.e., between about 16 volts and about 24 volts. For example, if the battery 20 is adapted to output a voltage of about 18 volts, then the motor 18 would be adapted to operate at a voltage of about 18 volts. Under a no-load condition, such a motor 18 can operate at about 19,500 rpm with a current of about 2.7 amps. At maximum efficiency, the motor 18 can operate at about 17,040 rpm with a current of about 18.7 amps, a torque of about 153 mN-m (1560 g-cm), and an output of about 273 W. An example of such an 18 volt motor 18 may be a RS-775WC-8514 motor, manufactured by Mabuchi Motor Co., Ltd. of Chiba-ken, Japan. However, as noted above, any suitable type of motor adapted to operate above a 16 V nominal voltage could be used. For example, the motor may be a RS-775VC-8015 motor, also manufactured by Mabuchi Motor Co., Ltd., which has a nominal operating voltage of about 16.8 volts. As another example, the motor may be a motor adapted to operate at a 24 V nominal voltage. The output shaft of the motor 18 is connected to the pump 16 by a gear reduction or gearbox 48. Any suitable type of gear reduction assembly 48 could be provided.

Referring again to FIG. 2, the tool 10 may include a poppet valve 50 connected to the hydraulic drive conduit system 28. The poppet valve 50 is adapted to open when the conduit system 28 reaches a predetermined pressure, such as between about 8000 and about 11,000 psi. When the poppet valve opens, hydraulic fluid being pumped by the pump 16 can exit the conduit system 28 and return to the fluid reservoir 22. The poppet valve 50 can be adapted to generate an audible sound when it opens. This audible sound can signal to the operator that the tool 10 has reached its maximum predetermined hydraulic pressure and, thus, the action of the working head 14, e.g., crimping and/or bending action, is completed.

In the exemplary embodiment shown in FIG. 2, the controller 24 is adapted to sense a current drop of electricity to the motor 18. When the poppet valve 50 opens, resistance to rotation of the motor 18 is reduced such that the motor draws less current. The controller 24 senses this current drop via a current sensor 120 (not shown), and automatically deactivates the motor 18 for a predetermined period of time. In a preferred embodiment, the predetermined period of time is between about 2 seconds and about 3 seconds. However, any suitable predetermined period of time could be set. In an alternate embodiment, the controller 24 could be adapted to deactivate the motor 18 until a reset button or reset like procedure is performed by the operator. With this type of system, an operator can sense via a tactile feedback that the motor 18 and pump 16 have stopped and would not need to rely on an audible signal being heard or a visual signal from an LED positioned on the tool 10. Crimping die sets are available that can be inserted in working area 34 for crimping wire cables to wire lugs. In addition, according to embodiments of the present disclosure described below, wire lug bending die sets are provided for bending wire lugs as desired.

Figure 3:
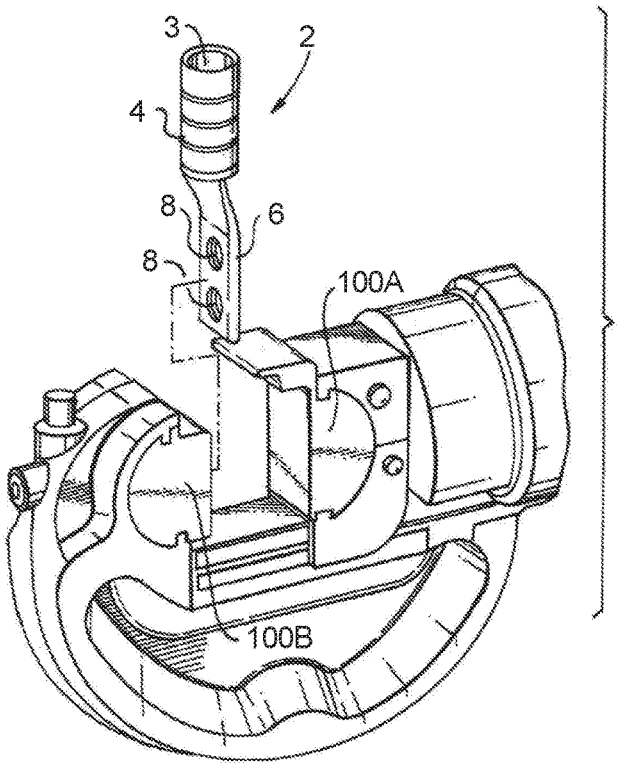
FIGS. 3 and 4 are partial perspective views for describing a die set for bending a work piece at a 90 degree angle according to an embodiment of the present disclosure.
Figure 4:
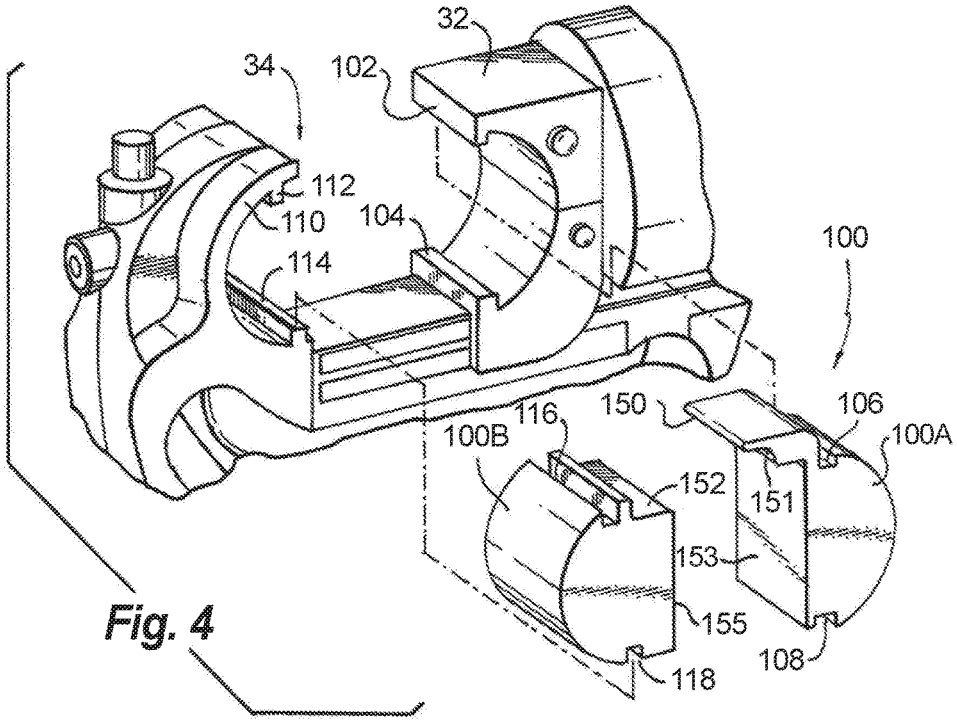

According to an embodiment of the present disclosure as shown in FIGS. 3 and 4, a die set 100 includes die 100A and corresponding die 100B which are inserted in receiving area 34 of tool 10. According to this embodiment of the present disclosure, the die set 100 is utilized for making a 90 degree bend in a workpiece such as a wire lug. The distal ends of ram 32 include protruding edges 102 and 104. Die 100A includes slots 106 and 108 that slidably engage protruding edges 102, 104, respectively as shown. Fixed end 110 of tool 10 includes protruding edges 112, 114. Die 100B includes slots 116 and 118 that slidably engage protruding edges 112, 114, respectively as shown. The slots and protruding edges allow the dies to be removably attached to the working end of tool 10 as shown. According to an embodiment of the present disclosure, dies 100A and 100B are interchangeable. Die 100A includes vertical surface 153 and a substantially horizontal member surface 150 extending from a top edge thereof. Horizontal member surface 150 includes an arched rollover surface 151, the purpose of which will be described later below. Die 100B includes a vertical surface 155 which corresponds to vertical surface 153 of die 100A and a substantially flat surface 152 which is perpendicular to surface 155.

A workpiece to be bent in this example is a two holed straight wire lug 2 as shown in FIG. 3. The wire lug 2 includes an end 4 having a tubular opening 3 which is dimensioned for receiving a cable of a specified diameter or a cable within a specified range of diameters. The cable is permanently attached to end 4 of wire lug 2 by a crimping process utilizing tool 10 and crimping dies (not shown). The wire lug 2 also includes a substantially straight flat end 6 having one or more holes 8 therein. Holes 8 are dimensioned for attachment to an attachment point such as, for example, a threaded post.

Figure 5:
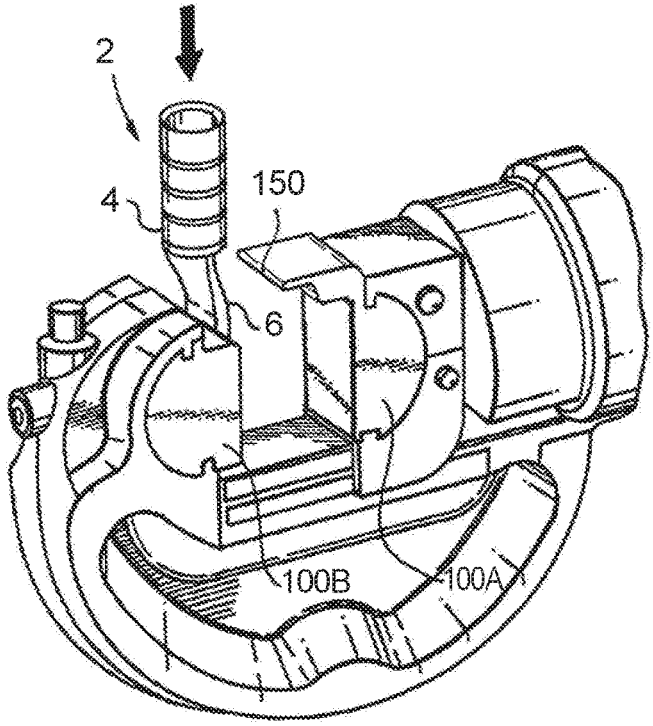
FIGS. 5, 6 and 8 are partial perspective views showing the die set described with respect to FIGS. 3 and 4 at various stages during bending of a work piece, according to an embodiment of the present disclosure.
Figure 6:
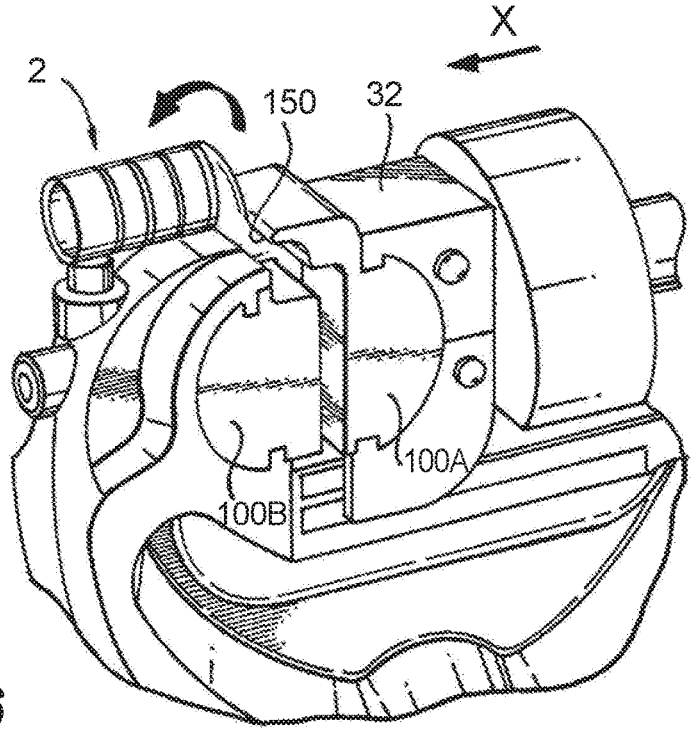
Figure 7:
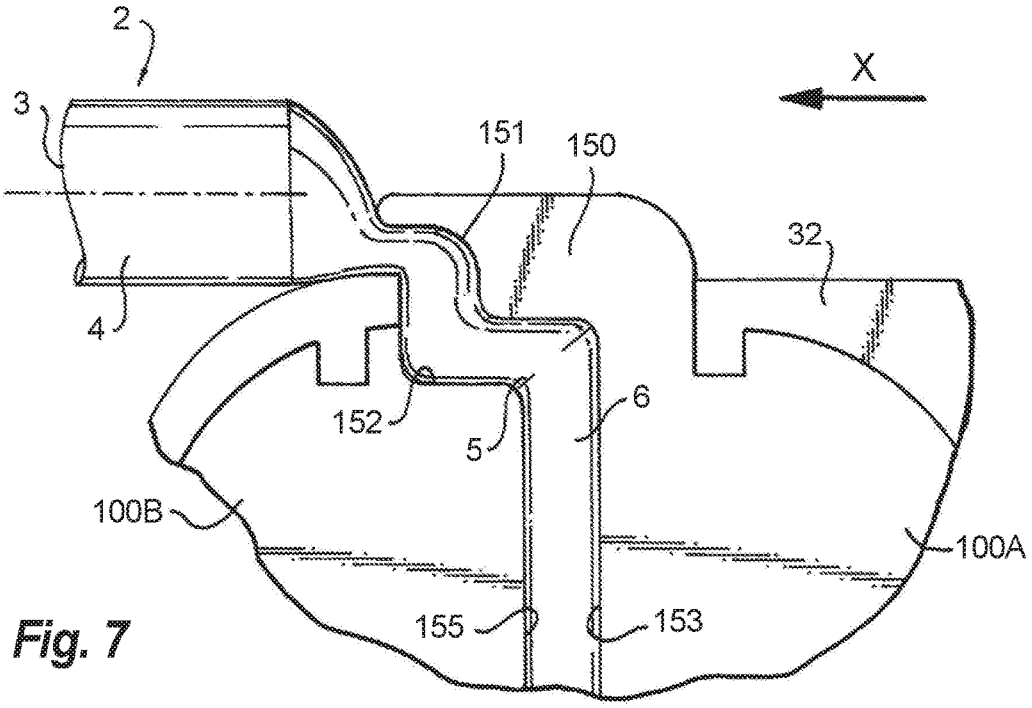
FIG. 7 is a close up view of a work piece being bent utilizing the die set shown in FIGS. 3 and 4 according to embodiments of the present disclosure.
Figure 8:
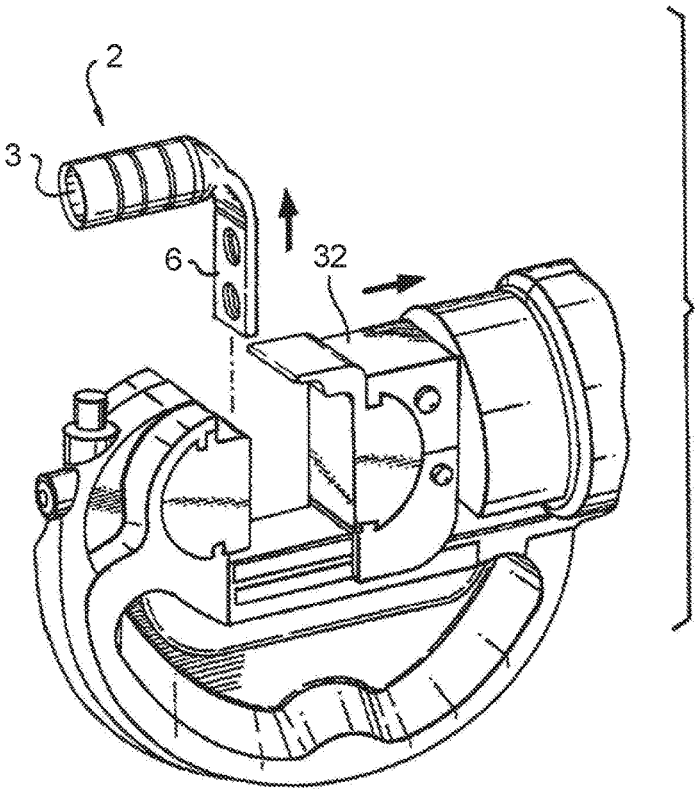

As shown in FIG. 5, with the ram 32 in the retracted position, the flat end 6 of wire lug 2 is inserted into a work area between dies 100A, 100B and held in position by the operator. The operator then presses trigger 44 of tool 10 causing the ram 32 to move in direction X as shown in FIG. 6 until the operator receives an audible and/or tactile feedback from tool 10 as described above indicating that the motor 18 and/or pump 16 have stopped. As shown in close-up in FIG. 7, horizontal surface 150 of die 100A and horizontal surface 152 of die 100B bend the wire lug 2 at point 5 to a 90 degree angle. In addition, arched rollover surface 151 of die 100A smoothly rolls the end 4 of wire lug 2 such that the tubular opening 3 of wire lug 2 is at a 90 degree angle relative to flat end 6. The operator then presses trigger 46 retracting ram 32 to the position as shown in FIG. 8 so that now bent wire lug 2 can be easily removed.

Figure 9:
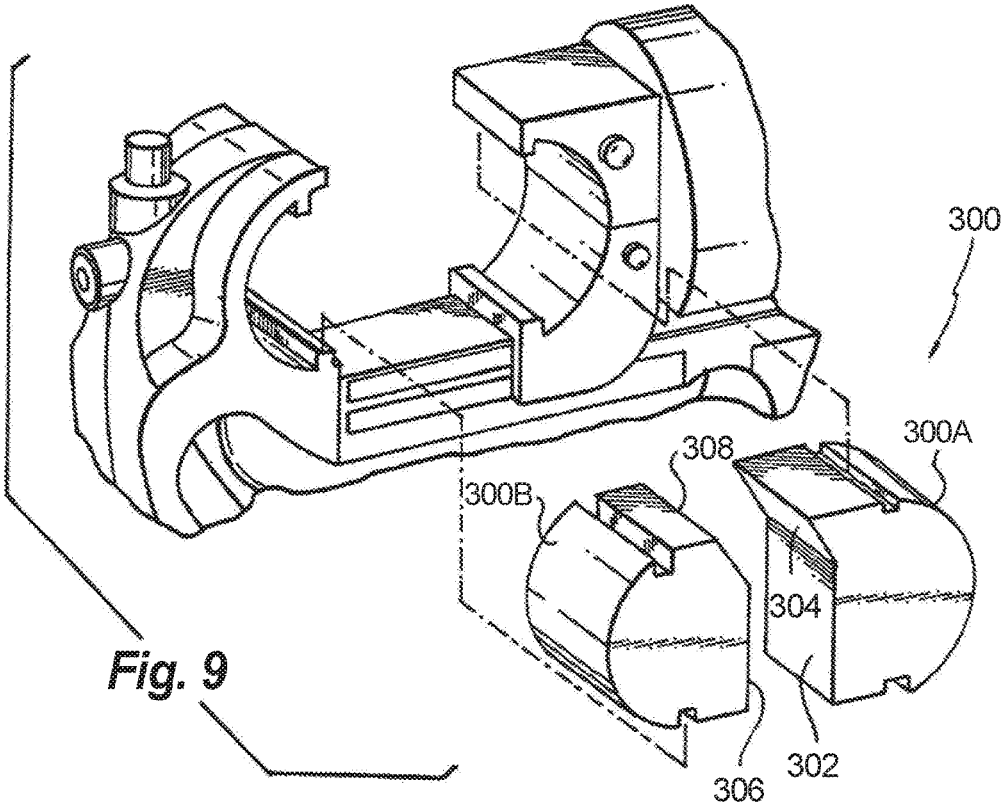
FIGS. 9 and 10 are partial perspective views for describing a die set for bending a work piece at a 30 degree angle according to illustrative embodiments of the present disclosure.
Figure 10:
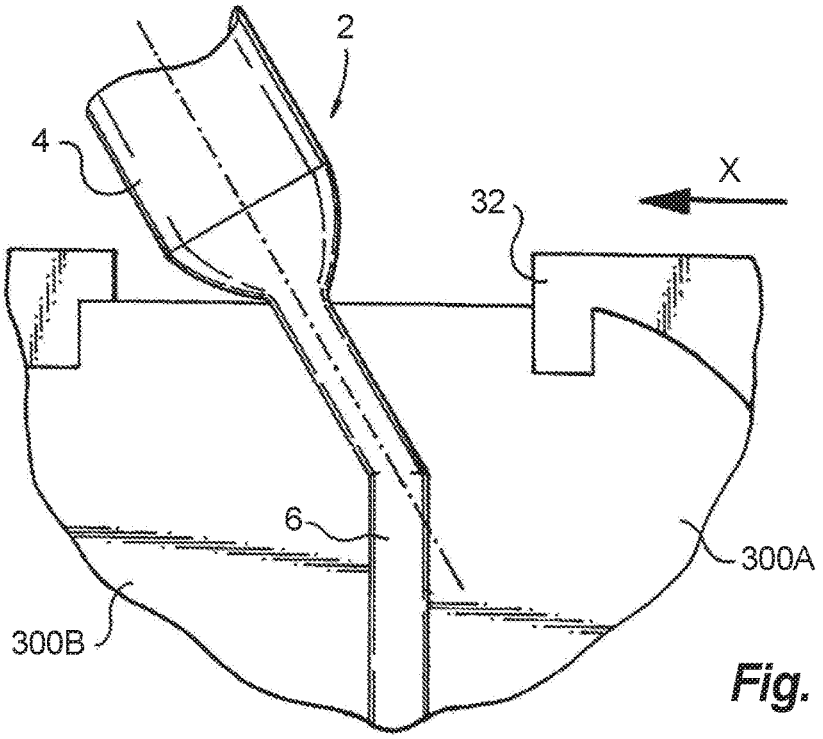

According to an embodiment of the present disclosure as shown in FIGS. 9 and 10, a die set 300 is provided for making a 30 degree bend in a workpiece such as wire lug 2. Die 300A includes a vertical surface 302 and a surface 304 that is 30 degrees from vertical as shown. Die 300B includes corresponding surfaces 306 and 308 as shown. The flat end 6 of wire lug 2 is inserted into the work area between dies 300A and 300B and held in place by the operator. The operator presses trigger 44 causing ram 32 to move in direction X, bending flat end 6 of wire lug 2 such that end 4 of wire lug 2 is bent at a 30 degree angle with respect to flat end 6 of wire lug 2. Ram 32 can then be retracted so that wire lug 2 can be removed.

Figure 11:
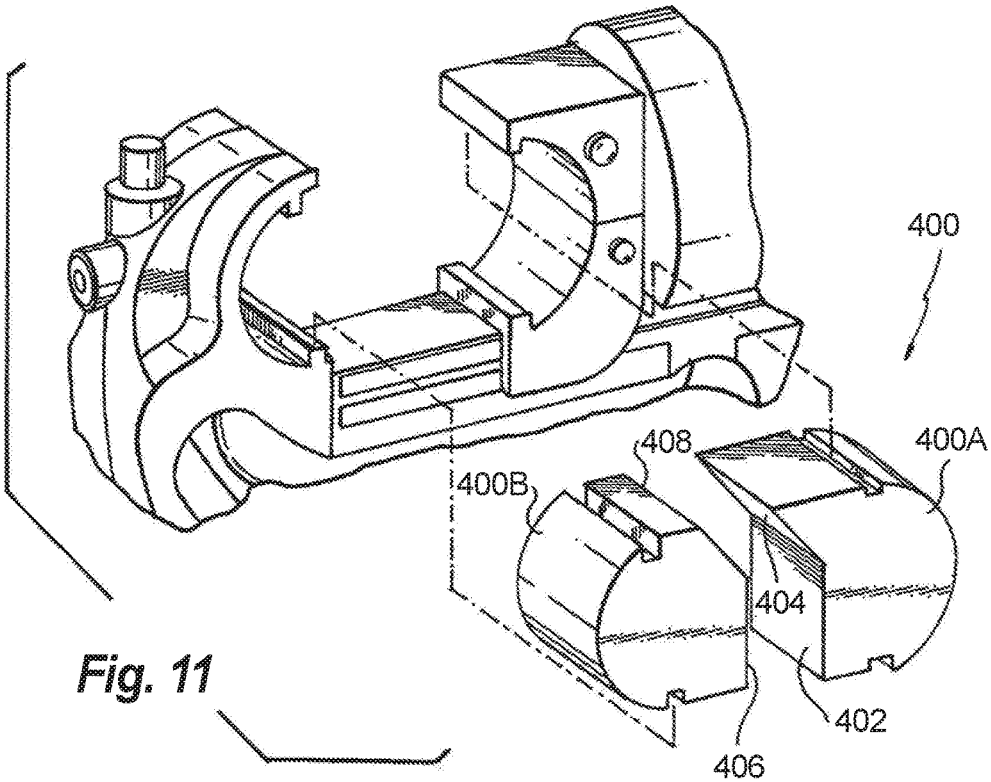
FIGS. 11 and 12 are partial perspective views for describing a die set for bending a work piece at a 45 degree angle according to illustrative embodiments of the present disclosure.
Figure 12:
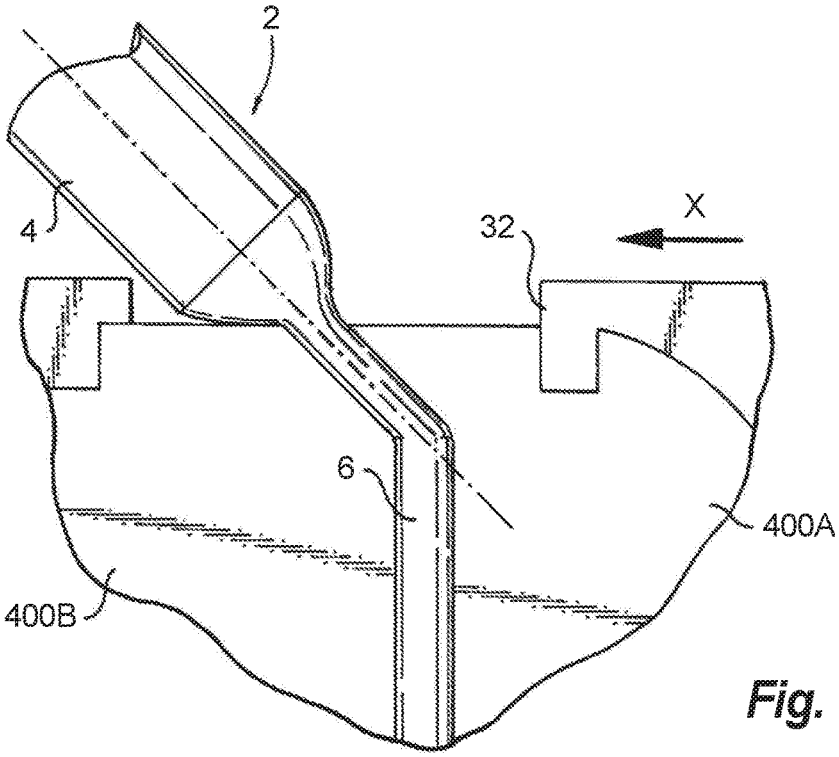

According to an embodiment of the present disclosure as shown in FIGS. 11 and 12, a die set 400 is provided for making a 45 degree bend in a workpiece such as wire lug 2. Die 400A includes a vertical surface 402 and a surface 404 that is 45 degrees from vertical as shown. Die 400B includes corresponding surface 406 and 408 as shown. The flat end 6 of wire lug 2 is inserted into the work area between dies 400A and 400B and held in place by the operator. The operator presses trigger 44 causing ram 32 to move in direction X, bending flat end 6 of wire lug 2 such that end 4 of wire lug 2 is bent at a 45 degree angle with respect to flat end 6 of wire lug 2. Ram 32 can then be retracted so that wire lug 2 can be removed.

The die sets contemplated by the present disclosure are not limited to those described above. For example, die sets may be provided for bending straight wire lugs to any suitable angle, generally from 0 to 135 degrees. Of course, die sets may be provided for bending straight wire lugs to angles greater than 135 degrees as desired for a particular job. That is, die sets can be provided such that virtually any angled bend can be made in the wire lug 2. In addition, although the above described embodiments describe bending straight wire lugs, the die sets disclosed herein are capable of bending even wire lugs that are pre-bent to a particular angle to any other angle as desired. In addition, the above-described dies are capable of bending various sizes and types of wire lugs and are not limited to the particular wire lugs shown. For example, any suitable wire lug capable of fitting within the die sets may be used. The above described die sets may also be utilized for bending items other than wire lugs including, for example, ground bars, connectors, etc.

In the above-described embodiments, the wire lug is shown prior to a wire or cable being crimped onto the wire lug. Of course, if desired, the wire or cable may be crimped onto the wire lug prior to bending.

It is noted that the outside surfaces of the die sets described above are semicircular in cross section to match the portions of the tool on which they are to be attached. It will be appreciated that the present disclosure is not limited to the crimping/bending tool described herein and the outside surfaces of the dies sets may be provided in any suitable size and shape designed to fit the particular crimping/bending tool being used.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

What is claimed is:

1. A die set for changing the shape of a work piece by gripping a first portion of the work piece and bending a second portion of the work piece utilizing a hand held tool, the die set comprising:

a first die including a first planar surface having a first end and a second end relative to a longitudinal axis of the first planar surface and a first bending surface positioned at the first or the second end of the first planar surface, the first bending surface being angled relative to the first planar surface a predetermined number of degrees by an arched rollover surface; and a second die including a second planar surface having a first end and a second end relative to a longitudinal axis of the second planar surface and a second bending surface positioned at the first or the second end of the second planar surface, the second bending surface being angled relative to the second planar surface and corresponding to the first bending surface of the first die;

wherein the first planar surface of the first die corresponds to the second planar surface of the second die so that the first and second planar surfaces can grip the first portion of the work piece; and wherein when the first bending surface of the first die and the second bending surface of the second die are moved toward each other the first and second bending surfaces bend the second portion of the work piece to impart an angle onto the work piece.

2. The die set as recited in claim 1, wherein the predetermined number of degrees is 90 degrees.

3. The die set as recited in claim 2, wherein the first bending surface of the first die is substantially perpendicular to the first planar surface of the first die, and wherein the second bending surface of the second die is substantially perpendicular to the second planar surface of the second die.

4. The die set as recited in claim 3, wherein the arched rollover surface of the first bending surface is capable of rounding at least a portion of the second portion of the work piece as the bending surfaces bend the second portion of the work piece.

5. The die set as recited in claim 1, wherein the predetermined number of degrees is between 0 and 180 degrees.

6. The die set as recited in claim 5, wherein the predetermined number of degrees is between 0 and 135 degrees.

7. The die set as recited in claim 1, further comprising slots provided on an outside surface of the first and second dies that can be aligned with tabs provided on the hand held tool on which the die set is to be attached, such that the first and second dies can be slid onto and off of the hand held tool.

8. The die set as recited in claim 7, wherein at least a portion of the outside surface of the first and second dies are sized and dimensioned to correspond to surfaces on the hand held tool to which the die set is to be attached.

9. The die set as recited in claim 8, wherein at least portion of the outside surface of the first and second dies are semicircular in cross section.

10. A die set for changing the shape of a flat portion of a work piece by gripping a first portion of the work piece and bending a second portion the work piece utilizing a hand-held tool, the die set comprising:

a first die including a first gripping surface having a first end and a second end relative to a longitudinal axis of the first gripping surface and a first bending surface positioned at the first or the second end of the first gripping surface, the first bending surface being angled relative to the first gripping surface a predetermined number of degrees by an arched rollover surface; and a second die including a second gripping surface having a first end and a second end relative to a longitudinal axis of the second gripping surface and a second bending surface positioned at the first or the second end of the second gripping surface, the second bending surface being angled relative to the second gripping surface and corresponding to the first bending surface;

wherein the first gripping surface corresponds to the second gripping surface so that the gripping surfaces can grip the first portion of the work piece; and wherein when the first bending surface and the second bending surface are moved toward each other the bending surfaces bend the second portion of the work piece to impart an angle onto the flat portion work piece.

11. The die set as recited in claim 10, wherein the predetermined number of degrees is between 0 and 180 degrees.

12. The die set as recited in claim 10, wherein the predetermined number of degrees is 90 degrees.

13. A die set for changing the shape of a work piece by gripping a first portion of the work piece and bending a second portion of the work piece using a hand held tool, the die set comprising:

a pair of opposing dies having at least two sets of opposing surfaces, wherein a first set of opposing surfaces includes:

a first planar surface having a first end and a second end relative to a longitudinal axis of the first planar surface; and a second planar surface having a first end and a second end relative to a longitudinal axis of the second planar surface; and a second set of opposing surfaces includes:

a first bending surface positioned at the first or the second end of the first planar surface, the first bending surface being angled relative to the first planar surface a predetermined number of degrees by an arched rollover surface; and a second bending surface positioned at the first or the second end of the second planar surface, the second bending surface being angled relative to the second planar surface and corresponding to the first bending surface;

wherein the first set of opposing surfaces form a work area that can grip the first portion of the work piece, and the second set of opposing surfaces can bend the second portion of the work piece the predetermined number of degrees.

14. The die set as recited in claim 13, wherein the predetermined angle is 90 degrees.

15. The die set as recited in claim 14, wherein the arched rollover surface is capable of rounding a portion of the work piece when the second of the at least two sets of opposing surfaces bend the second portion of the work piece.

16. The die set as recited in claim 13, wherein the predetermined angle is between 0 and 180 degrees.

17. The die set as recited in claim 16, wherein the predetermined angle is between 0 and 135 degrees.

18. The die set as recited in claim 13, further comprising slots provided on an outside surface of the pair of opposing dies that can be aligned with tabs provided on the hand held tool on which the die set is to be attached, such that the opposing dies can be slid onto and off of the hand held tool.

19. The die set as recited in claim 18, wherein at least a portion of the outside surface of the pair of opposing dies are sized and dimensioned to correspond to surfaces on the hand held tool on which the die set is to be attached.

20. The die set as recited in claim 19, wherein at least portion of the outside surface of the opposing dies are semicircular in cross section.

* * * * *